US005343641A

United States Patent [19]

Gregory

[11] Patent Number: 5,343,641

[45] Date of Patent: Sep. 6, 1994

[54] SPREADER BAR FOR STRIP MINE RIGGING APPARATUS

[76] Inventor: George Gregory, 1114 Brookshire, Tyler, Tex. 75703

[21] Appl. No.: 962,246

[22] Filed: Oct. 16, 1992

[51] Int. Cl.[5] ..... E02F 3/46

[52] U.S. Cl. ..... 37/397; 37/399; 37/396

[58] Field of Search ..... 37/115, 116, 117, 118 R, 37/135, DIG. 12, 71, 395, 397, 396, 399, 401

[56] References Cited

U.S. PATENT DOCUMENTS 3,541,710 11/1970 Sankey et al. ..... 37/115
3,597,865 8/1971 Rumfelt ..... 37/135
4,329,794 5/1982 Rogers ..... 37/115
4,689,904 9/1987 Briscoe ..... 37/135
4,791,738 12/1988 Briscoe ..... 37/116
4,944,102 7/1990 Behlendorf et al. ..... 37/135

*Primary Examiner*—Dennis L. Taylor
*Assistant Examiner*—J. Russell McBee
*Attorney, Agent, or Firm*—Hubbard, Thurman, Tucker & Harris

[57] ABSTRACT

A spreader bar assembly has a middle spreader bar having a nose-shaped link at opposite ends to which is pivoted pivotal end pieces which comprise about half of the structural weight. The pivotal end pieces have a rounded tip portion which is pivotally connected to the nose-shaped link by pin members which are secured by keepers. The pivotal end pieces have upper and lower transverse openings for pins in order to connect the chains of a hoist which also connect an excavator bucket. Greatly increased life before failure results from the three-piece construction.

8 Claims, 3 Drawing Sheets

SPREADER BAR FOR STRIP MINE RIGGING APPARATUS

TECHNICAL FIELD OF THE INVENTION

The present invention relates to a spreader bar for a strip mine excavator bucket. Specifically, the spreader bar incorporates pivotally attached spreader bar ends to absorb vibration.

BACKGROUND OF THE INVENTION

Strip mining is a common method of mining coal or excavating large areas of land. Therefore, strip mining operations involve the use of extremely heavy and rugged digging equipment capable of moving millions of pounds of earth. Typically, drag lines manipulate the position of a "bucket" used to dislodge, hold, and remove the soil from the site. A bucket can be virtually any size. For example, a bucket can be 35 feet long, 20 feet wide and 15 feet in depth, and weigh approximately 100,000 pounds. One end of the bucket is open with a toothed lower lip. The bucket is attached to a boom by a number of wire ropes and chains. These ropes and chains can bear the weight of the load in the bucket as well as control the orientation of the bucket.

One method of strip mining, known as "chopping," tips the bucket vertically with the toothed lip downward. The bucket is lifted several hundred feet above the ground and then allowed to free fall into the ground. The weight of the falling bucket dislodges a large quantity of soil which is then contained within the bucket. The bucket is then lifted and tilted to a horizontal orientation to prevent the soil from falling out of the bucket. The bucket is next moved to another location and tilted vertically. A spreader bar is an essential component in the dumping procedure. The spreader bar "spreads " the hoist chains away from the sides of the bucket. It is comprised of a bar that is interconnected to the hoist chains. If the spreader bar fails, the chains tend to bind against the sides of the bucket, inhibiting its ability to dump a load.

The spreader bar tends to fail in two ways. First the spreader bar can bend in the center, shortening its effective length. This is also known as arching. Second, the spreader car can simply break. In either case, the hoist chains contact the sides of the bucket inhibiting its function and even possibly damaging the bucket. Failure is caused by the cyclical loading, i.e. vibration, experienced by the spreader bar during use.

Prior art spreader bars are rigid. The central portion and ends act as one piece. Any jarring experienced by the ends during chopping are transmitted to the central portion as well. A need exists for a spreader bar that diminished the amount of force transmitted to the central portion.

The prior art spreader bars are one piece bars which are essentially straight with opposite end portions adapted for hook-up to the excavator hoist chains and chains extending downwardly to the bucket of a drag line, for example. Each opposite end of a conventional spreader bar has upper and lower pin openings which receive a pin that engages the end of the spreader bar to a lifting chain on a hoist. The lower pin opening is for the lower pin which engages a shorter chain which is connected to a pivot point on the bucket behind its center of gravity so that when the bucket is hoisted by the upper chains, the bucket will tilt into a vertical orientation.

The spreader bars are used on massive pieces of equipment which are used in the heaviest earth moving operations. For an exemplary 90 cubic yard bucket, a spreader bar may be approximately 20 inches in diameter, 18 feet long and weight approximately 20,000 pounds. When the bucket is dropped in the "chopping" operation, this huge spreader bar falls against the closed back end of the bucket as the bucket strikes the earth. Repeated use of this procedure causes the spreader bars to fail no matter what material they are made of.

Failure occurs primarily by two modes. In the first mode, the spreader bar gradually becomes arched to the point where the chains which extend downwardly from the spreader bar come in contact with the sides of the bucket and interfere with its ability to tilt and dump. Binding of these chains necessitates replacement of the spreader bar. The second mode of failure is by fracture of the spreader bar because of repeated blows. Failure of the conventional spreader bars usually occurs within three months of continuous use. It is a major operation to replace them because of the massive size of the equipment which typically may involve five or six hours of downtime on a machine that may cost $7,000 an hour to operate. Because the conventional spreader bar is in one piece and has four pine, two at each end, there are four pins to remove in order to disconnect it from the chains which may have massive links 24 inches long. The whole bar must be replaced. Therefore, a need exists for an improved spreader bar.

SUMMARY OF THE INVENTION

The spreader bar of the invention is of the same general length as a conventional spreader bar because it must retrofit an existing drag line bucket. The present invention has three piece construction instead of single piece construction in that there is a middle spreader bar portion which spreads the lifting chains apart and supports the load imposed by the lifting chains. The middle spreader bar portion has a general "I"-beam construction which has been modified to provide a nose-shaped link at each of the opposite ends. The nose-shaped link extends beyond the flanges of the modified "I"-beam and has a transverse opening to accept and receive a pivotal end piece which has transverse openings which in assembly match the opening in the nose-shaped link such that they are pivotally connected by means of a sturdy pin which has a keeper to hold it in place. The pivotal end pieces are adapted to fit over the nose shaped link so that the transverse openings will accept the pin which holds them together. The opposite ends of the middle spreader bar also have an arcuate bearing-like surface which receive a rounded tip portion of the pivotal end piece which can help stabilize the pivotal end piece, especially if the transverse openings become worn or egg-shaped with repeated blows during use.

The pivotal end pieces are preferably constructed of spaced apart plate portions which are secured together by cross members and have coextensive transverse upper openings and transverse lower openings which accept an upper pin and a lower pin to support the bucket from the lower pin and be supported from the upper pin by the upper chains which are connected to the hoisting mechanism. The pivotal end pieces have a generally triangular shape with one point of the triangle connected to the end of the middle spreader bar and the other points being connected to the upper and lower chains by means of transverse pins for each of the upper and lower holes which are passed through the chain and secured with keepers alongside one of the plate portions. Thus, the last link of the upper and lower chains are held between the spaced apart plate portions of the pivotal end pieces and free to move in supporting contact with the transverse lifting pins. A typical spreader bar assembly of the invention might weigh 20,000 pounds of which the pivotal end pieces each weight approximately 5,000 pounds, which shows the relationship between the parts. Half of the weight is in the ends which are pivotally connected to the middle spreader bar portion.

When the bucket is dropped in the "chopping" operation, the middle spreader bar still falls on the closed bottom end of the bucket, but approximately half its weight is in the end pieces which are free to pivot after the initial contact until a stopping surface on the pivotal ends engages a complementary stopping surface on the ends of the middle spreader bar which takes place as a secondary action after the initial impact. Even if the impact occurs only a few microseconds later than the initial impact, the effect is to considerably reduce the damage to the spreader bar that results from dropping the bucket. Only about half the mass is associated with the initial impact, and the other half associated with the secondary impact so that the net effect is that the spreader bar assembly is subjected to considerably lees wear and tear which results in at least a doubling of the life before replacement is necessary. In fact, it is expected that the spreader bar assembly of the present invention will last at least four times as long.

There is a considerable cost savings associated with the increased life of the improved spreader bar. Because of the massive size of these units and the fact that the whole conventional unit has to be replaced, and replaced more often, there is a considerable cost saving to the user. In addition, approximately 80–90% of the time the only damage which occurs to the spreader bar of the present invention is to the replaceable middle bar part which is considerably cheaper than the whole conventional unit. Thus, for example, the replacement might be accomplished for approximately ⅓ of the cost of the replacement of the whole conventional spreader bar.

A further cost savings is an estimated approximately 40% labor savings which is associated with the removal of only two pine to replace the pivotal end pieces of the present invention as opposed to replacing four pins in the conventional spreader bar which is a savings of the installation of two pins. This might not sound significant, except that when one considers the massive size of the equipment and the very expensive nature of the downtime associated with lack of use of the equipment which is a significant savings in cost. The savings in down time is also significant, especially when one considers that the replacement takes place much less frequently. The pivotal end pieces are universal in that so long as the rounded tip portion is placed against the nose-shaped link on the middle spacer bar, the two pieces can be installed in either orientation.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
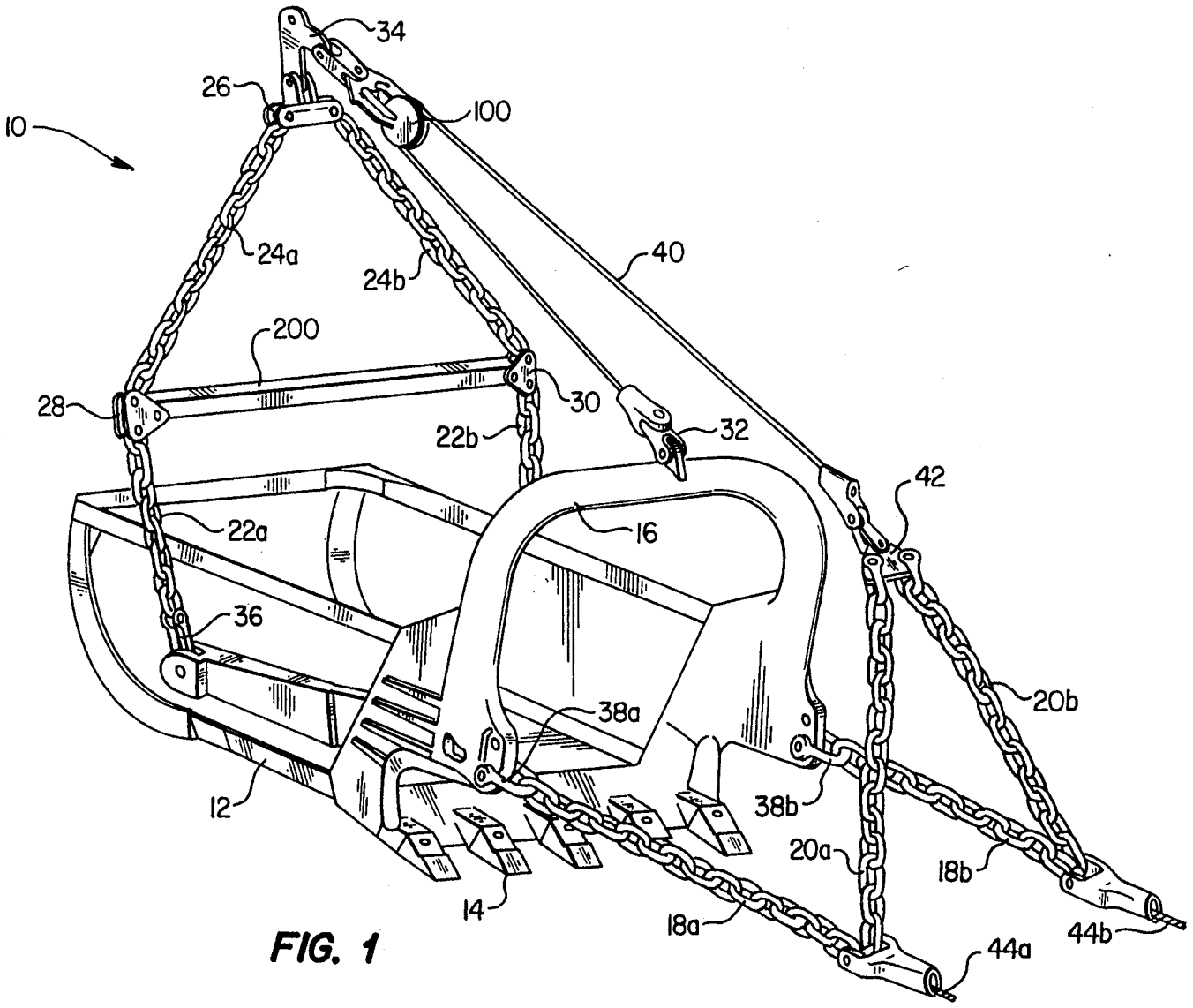
FIG. 1 is an exploded perspective view of a bucket assembly which includes a spreader bar in accordance with the present invention.

The present invention relates to a dump block for strip mine rigging apparatus that overcomes many of the disadvantages found in the prior art. Referring to FIG. 1, a dump block embodying the present invention is shown in an exploded perspective view with a bucket. The bucket assembly 10 generally comprises a bucket 12 with a plurality of forward projecting teeth 14 and a forward arch 16. The bucket 12 is moved and manipulated by several sets of chains. Hoist chains 22, 24 are attached to the bucket behind the bucket's center of gravity. Drag chains 18 are attached to the forward portion of the bucket 12 on either side of the bucket mouth. Drag ropes 44 are attached to both the drag chains 18 and to the dump chains 20.

A dump block 100 is shown attached between arch 16 and the drag chains 18. A dump rope 40 extends around the dump block with one end of the dump rope attached to arch 16 and the other end attached to dump chains 20. In operation, the bucket is dropped vertically into the ground. Next, tension is applied to the drag chains causing the bucket to assume a horizontal position. The bucket is lifted from the ground several feet to facilitate moving the bucket and load to a dump site. To lift the bucket and load, tension is applied to both the hoist chains 22, 24 and to drag ropes 44. The resultant force on the bucket keeps the bucket horizontal. Dumping procedure is well known in the art. In sum, tension is released from the drag ropes 44. This allows the dump rope 40 to cycle through the dump block 100. The distance between the dump block 100 and the point at which the dump rope 40 attaches to the dump chains 20 decreases, thereby increasing the distance between the dump block 100 and the bucket arch 16. As the position of the dump block is fixed, the release of tension on the drag ropes 44 results in the lowering of the bucket front. When the bucket front is tipped below the bucket rear, the load slides through the bucket mouth.

A spreader bar 200 is shown between lower hoist chains **22*a*, 22*b* and upper hoist chains 24*a*, 24*b*. Upper hoist chains 24*a*, 24*b* attach to the primary hoist rigging 34 via fifth and sixth attachment means 26, 34. One end of spreader bar 200 is interconnected to the left upper hoist chain 24*a* and the left lower hoist chain 22*a* by first attachment means 28. The other end of spreader bar 200 is interconnected to the right upper hoist chain 24*b* and the right lower hoist chain 22*b* by a third attachment means 30. The lower left hoist chain 22*a* connects to the rear of the bucket 12 by second attachment means 36. Likewise, the right lower hoist chain 22*b* is similarly connected to the bucket 12. The spreader bar 200 prevents the upper and lower hoist chains 22, 24 from rubbing against the sides of the bucket. Rubbing can interfere with the ability of the bucket 12** to function.

Figures 2, 3:
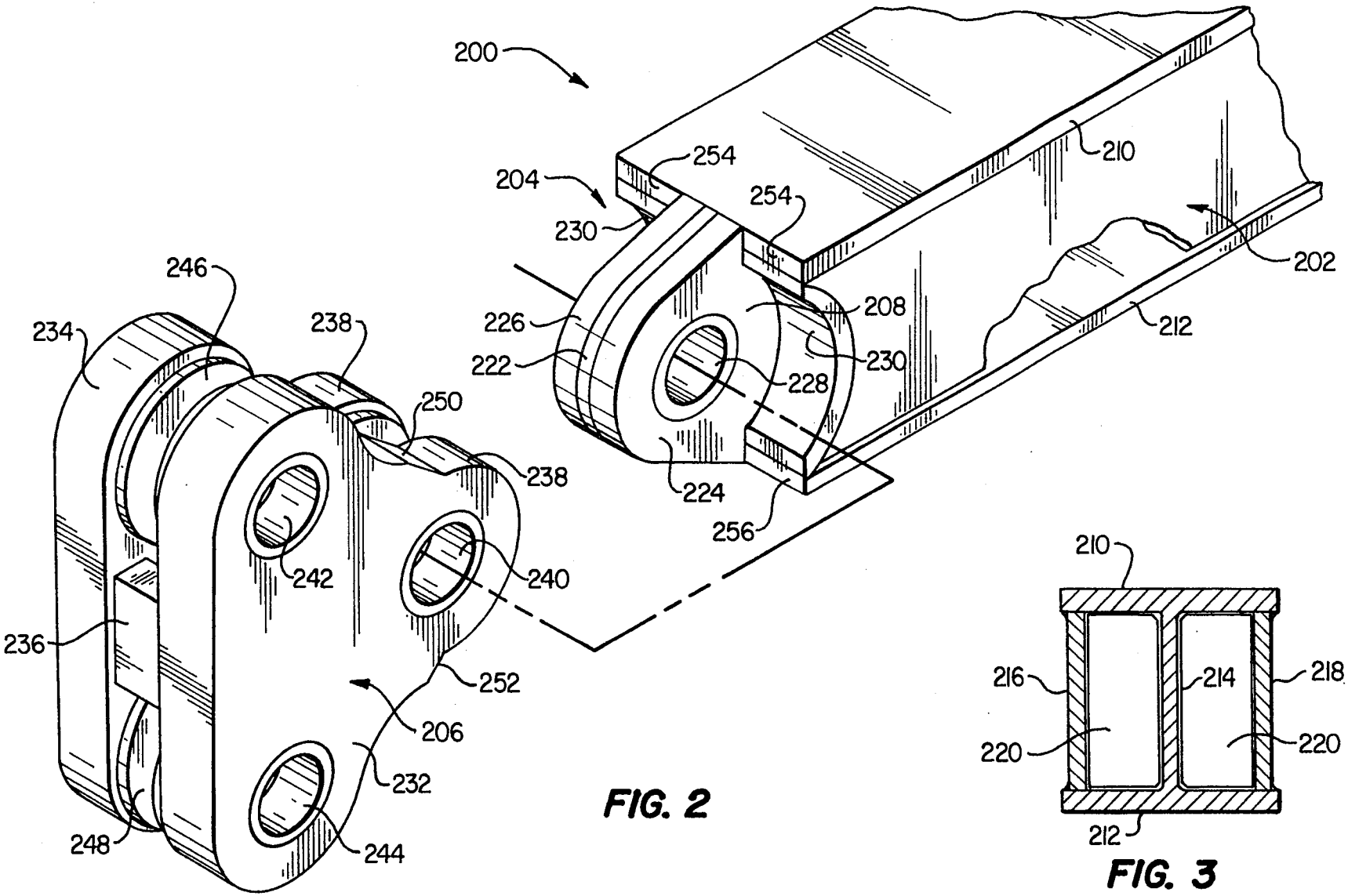
FIG. 2 is a perspective view showing the attachment of the spreader bar central portion and the spreader bar ends.
FIG. 3 is a sectional view across the spreader bar central portion.

In FIG. 2, a spreader bar assembly is generally referred to by the reference numeral 200. Spreader bar assembly 200 comprises a middle spreader bar 202 having opposite end portions generally designated 204 and a pair of pivotal end pieces 206 which are pivotally attached to a nose-shaped link 208 which extends from the opposite end portion 204 as seen in FIG. 2. Middle spreader bar 202 is formed from a modified "I"-beam having upper flange 210 and lower flange 212 which is seen in cross-section in FIG. 3. Between flanges 210,212 is a central web 214 which joins the flanges in the usual manner. In FIG. 3, stiffening plates 216,218 are welded between the flanges on either side of the "I"-beam to strengthen the structure. Internal transversely welded gussets 220 are spaced on about 12" to 18" centers which further strengthen the middle spreader bar.

Returning to FIG. 2, a portion of the flanges 210, 212 of the "I"-beam have been cut away, leaving a rounded portion 222 extending from the end of the "I"-beam. Thick plates 224,226 are shaped to fit on both sides of rounded portion 222 and alongside the internal extension of rounded portion 222 comprising flange 214 to form the nose-shaped link 208. A transverse opening 228 for a connecting pin is provided in nose-shaped link 208. Arcuate bearing-like surfaces 230 are formed on either side of nose-shaped link 208 in the end 204 of middle spreader bar 202. The entire structure is welded together.

Pivotal end pieces 206 have opposed plates 232,234 which are spaced apart and secured by transverse members 236 in sufficient number to provide a secure construction. Pivotal end pieces 206 have a rounded tip portion 238 which is formed on an extending portion of each of the spaced apart plate members 232,234 which cooperate with arcuate surfaces 230 and are shaped like the arcuate surfaces 230 to provide a stabilizing influence when the end pieces are connected. They are helpful in resisting torque forces or bending forces. The rounded tip portion 238 has a transverse opening 240. When the rounded tip portion 238 is slipped over the nose-shaped link 208, transverse openings 228,240 line up and accept a pin which is affixed with a keeper on the extending end to form a pivotal link between the end pieces and the spreader bar.

Also extending through pivotal end pieces 206 in FIG. 2 are upper and lower transverse openings 242 and 244 which accept and receive pins having keepers to hold them in place which are used to hold the chains illustrated in FIG. 1. The pin for opening 242 is surrounded by an upper bushing 246 and the pin for the opening 244 is surrounded by a lower bushing 248. The pins and bushings support the upper chains **24*a* and 24*b* at the opposite ends of the spreader bar assembly. The lower pins and bushings 248 support the lower chains 22*a* and 22*b*** which are attached to the bucket. The pins and bushings are removable so that the last link on the chains can be inserted between the spaced apart plates.

Finally, members 206 have upper stop surfaces 250 and lower stop surfaces 252 which cooperate with upper stop 254 and lower stop 256 which are formed by the terminal ends of the "I"-beam which comprises the middle spreader bar. These stop surfaces come into contact to limit the pivotal movement of pivotal end pieces 206 when connected to the nose-shaped link 208 and thus prevent any jamming of the pivoting linked members. It should be realized that the opposite pivotal end piece 206 from the one shown in FIG. 2 is essentially a mirror image attached at the other end. This is illustrated in FIG. 1.

Figure 4:
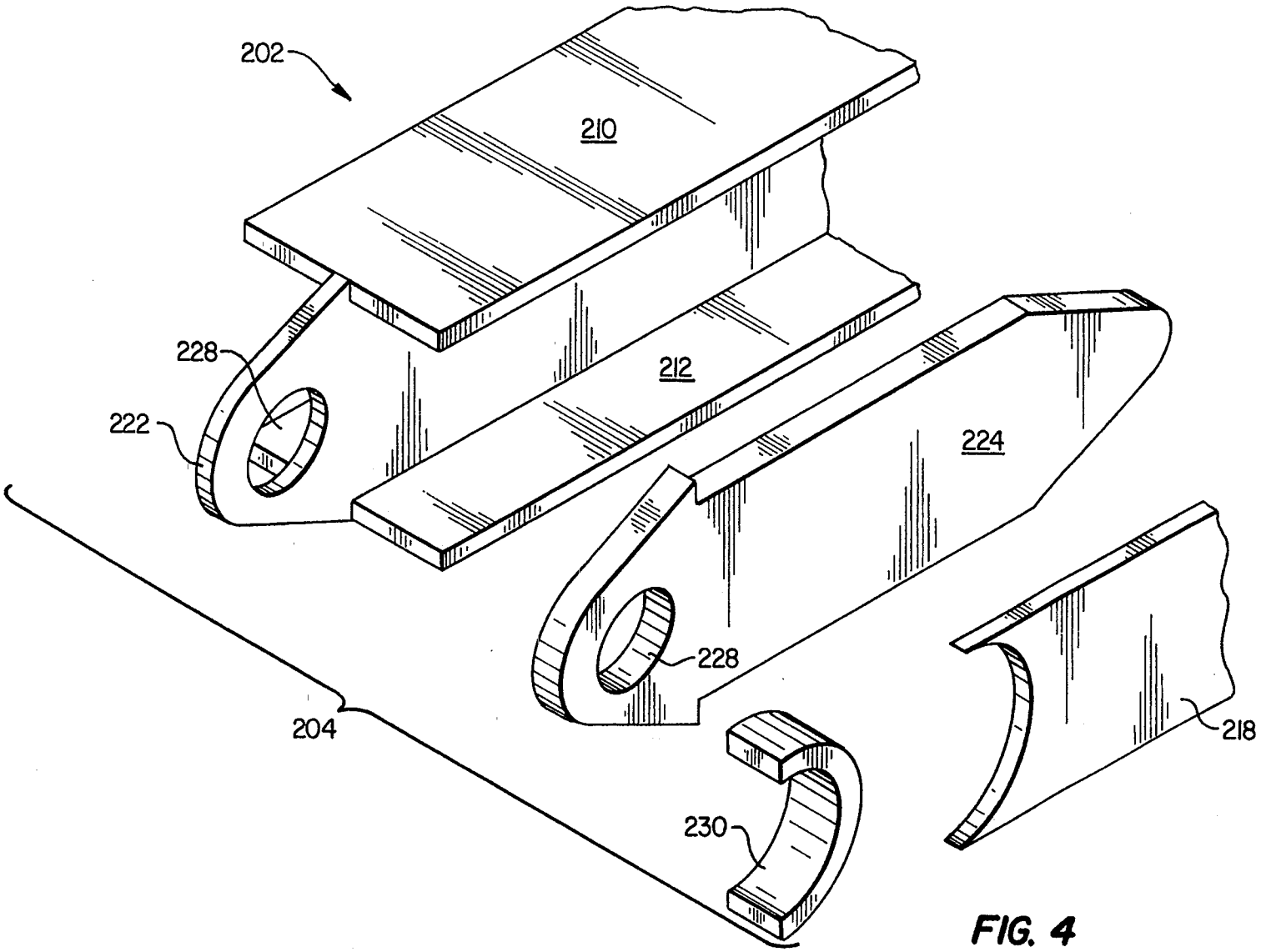
FIG. 4 is a cutaway perspective view showing the construction.

The construction assembly of the end portion 204 is more completely illustrated in FIG. 4 wherein a cutaway portion of the middle spreader bar is shown. Only the elements which make up one-half of the construction is shown. It is seen that the specially shaped thick plates 224 are designed to fit against the extending rounded portion of the web which remains after the flanges have been cut away as illustrated in FIG. 4. It is shaped to fit against the remaining rounded portion of the web and has an opening which is part of the opening 228 which extends therethrough. It is placed up against the side of the web of the "I"-beam and welded securely in place. Welded against it into a side plate 218 is an arcuate bearing-like surface 230 formed from a thick section of pipe which is welded in against the side of the thick plate 224.

In the best mode, the structure is made from a structural steel which is work hardenable and weldable. The square beam construction is stronger than the conventional tube construction and the pins which are not shown are preferably made from an alloy steel sold under the trade name Astralloy.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

I claim:

1. A spreader bar assembly for an excavating bucket, comprising:

(a) a structural member which serves to separate the lifting chains of an excavating bucket, said structural member having opposite ends;

(b) a pair of pivotal end pieces adapted to pivotally attach to the opposite ends of said structural member; and (c) connection means on the pivotal end pieces for connecting to the lifting chains of a hoist and to an excavating bucket for lifting the excavating bucket and controlling its position wherein the opposite ends of the structural member and the pivotal end pieces have a cooperating stop member which limits the pivotal motion of the pivotal end pieces with respect to the ends of the structural member.

2. The spreader bar assembly of claim 1 wherein the structural member is a box shaped based on a modified "I"-beam, said "I"-beam including a plurality of flanges joined by a central web.

3. The spreader bar assembly of claim 2 wherein the opposite ends of the flanges are cut away to expose a portion of the central web which is reinforced with plates and forms a rounded nose-shaped link on each end for attachment of the pivotal end pieces.

4. The spreader bar assembly of claim 3 wherein the opposite ends of the structural member have an arcuate bearing like surface which cooperates in assembly with a rounded tip portion of the pivotal end pieces to add structural integrity to the pivotal link.

5. The spreader bar assembly of claim 1 wherein the pivotal end pieces have spaced apart plate members joined together for structural strength.

6. The spreader bar assembly of claim 5 wherein the spaced apart plate members form a rounded tip portion having a transverse opening therethrough for accepting a pin member which also engages a round nose-shaped link on the opposite ends of the structural member for pivotal attachment therewith.

7. The spreader bar assembly of claim 6 wherein the spaced apart plate members have upper and lower openings therethrough for accepting lifting pins to comprise the connection means.

8. The spreader bar assembly of claim 7 wherein the rounded tip portion of the pivotal end pieces cooperates with corresponding arcuate bearing like surfaces on the ends of the structural member to add structural rigidity to the pivoting end pieces without interfering with the pivoting action.

* * * * *